US009359180B1

(12) United States Patent
Visconti

(10) Patent No.: US 9,359,180 B1
(45) Date of Patent: Jun. 7, 2016

(54) BEVERAGE CARRYING ASSEMBLY WITH BOTTLE OPENER

(71) Applicant: Steven A. Visconti, Staten Island, NY (US)

(72) Inventor: Steven A. Visconti, Staten Island, NY (US)

( * ) Notice: Subject to any disclaimer, the term of this patent is extended or adjusted under 35 U.S.C. 154(b) by 154 days.

(21) Appl. No.: 13/892,459

(22) Filed: May 13, 2013

(51) Int. Cl.
*B67B 7/00* (2006.01)

(52) U.S. Cl.
CPC ..... *B67B 7/00* (2013.01)

(58) Field of Classification Search
CPC ..... B25F 1/00; B67B 7/00; B67B 7/02; B67B 7/16; B67B 7/44
USPC ..... 81/3.09, 3.15, 3.57, 3.27
See application file for complete search history.

(56) References Cited

U.S. PATENT DOCUMENTS

| | | | | |
|---|---|---|---|---|
| 1,060,674 | A | 5/1913 | Foster | |
| 2,806,393 | A | 9/1957 | Vickers | |
| 2,821,101 | A * | 1/1958 | Hendricks | 81/3.09 |
| 2,875,654 | A * | 3/1959 | Straub | 81/3.15 |
| 2,990,972 | A | 7/1961 | Benedetti | |
| 3,055,541 | A | 9/1962 | Bonkowski | |
| 3,120,140 | A * | 2/1964 | Wiles | 81/3.09 |
| 4,335,814 | A | 6/1982 | Benning et al. | |
| 6,295,894 | B1 | 10/2001 | Craig | |
| 7,987,976 | B2 | 8/2011 | Stowers | |
| 2009/0049956 | A1 * | 2/2009 | Brennan | 81/3.57 |

* cited by examiner

*Primary Examiner* — Hadi Shakeri

(57) ABSTRACT

A beverage carrying assembly with bottle opener provides a readily accessible bottle opener for opening pop-top bottles. The assembly includes a container having a bottom side and a perimeter wall extending upwardly from the bottom side. The container has an interior space configured to hold a plurality of bottles therein. A bottle opener is coupled to the perimeter wall. The bottle opener comprises a panel and an opening extending from a front side to a back side of the panel. The opening extends through the perimeter wall and has a size configured to receive a bottle cap therein. An upper lip and a lower lip are coupled to the opening and each of the upper and lower lips are configured for receiving a lower edge of the bottle cap such that the bottle cap is removed when upward force is applied to the lower edge of the bottle cap.

18 Claims, 5 Drawing Sheets

BEVERAGE CARRYING ASSEMBLY WITH BOTTLE OPENER

BACKGROUND OF THE DISCLOSURE

Field of the Disclosure

The disclosure relates to beverage carrying assemblies and more particularly pertains to a new beverage carrying assembly for providing a readily accessible bottle opener for opening pop-top bottles stored within the assembly.

SUMMARY OF THE DISCLOSURE

An embodiment of the disclosure meets the needs presented above by generally comprising a container having a bottom side and a perimeter wall extending upwardly from the bottom side. The container has an interior space configured to hold a plurality of bottles therein. A bottle opener is coupled to the perimeter wall. The bottle opener comprises a panel and an opening extending from a front side to a back side of the panel. The opening extends through the perimeter wall and has a size configured to receive a bottle cap therein. An upper lip and a lower lip are coupled to the opening and each of the upper and lower lips are configured for receiving a lower edge of the bottle cap such that the bottle cap is removed when upward force is applied to the lower edge of the bottle cap.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
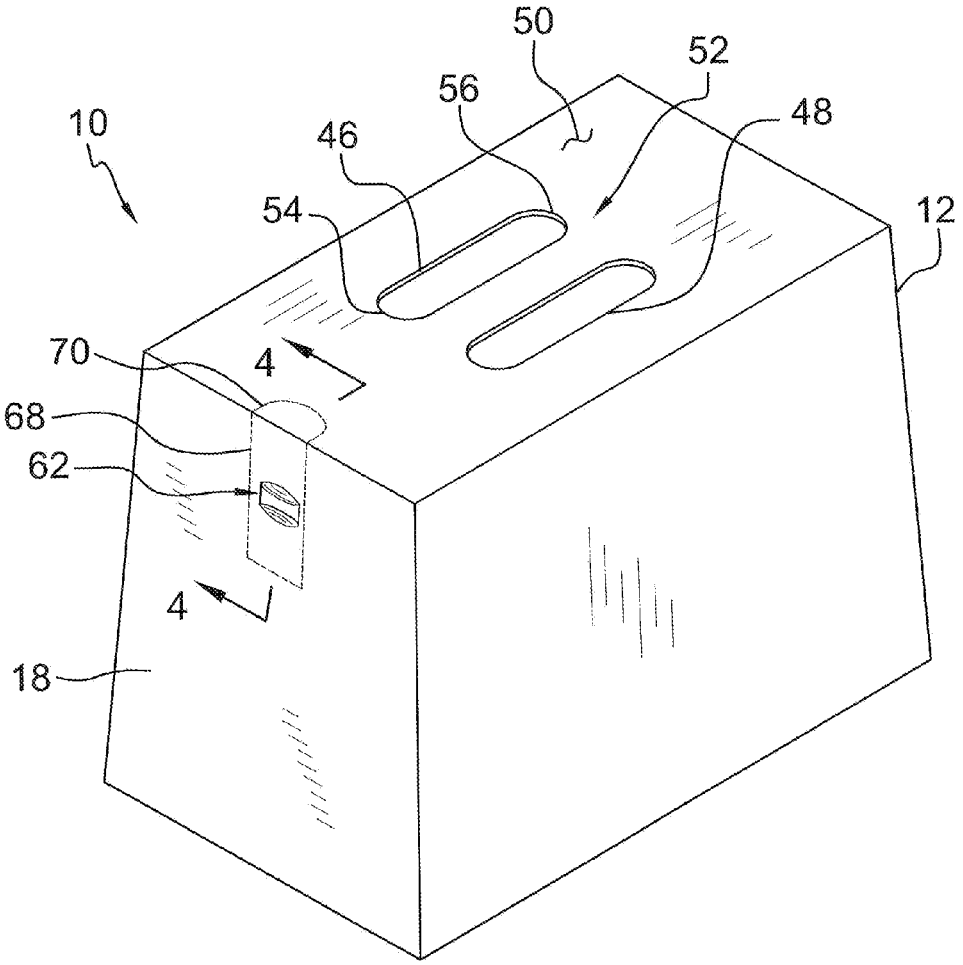
FIG. 1 is a top front side perspective view of a beverage carrying assembly with bottle opener according to an embodiment of the disclosure.
Figure 2:
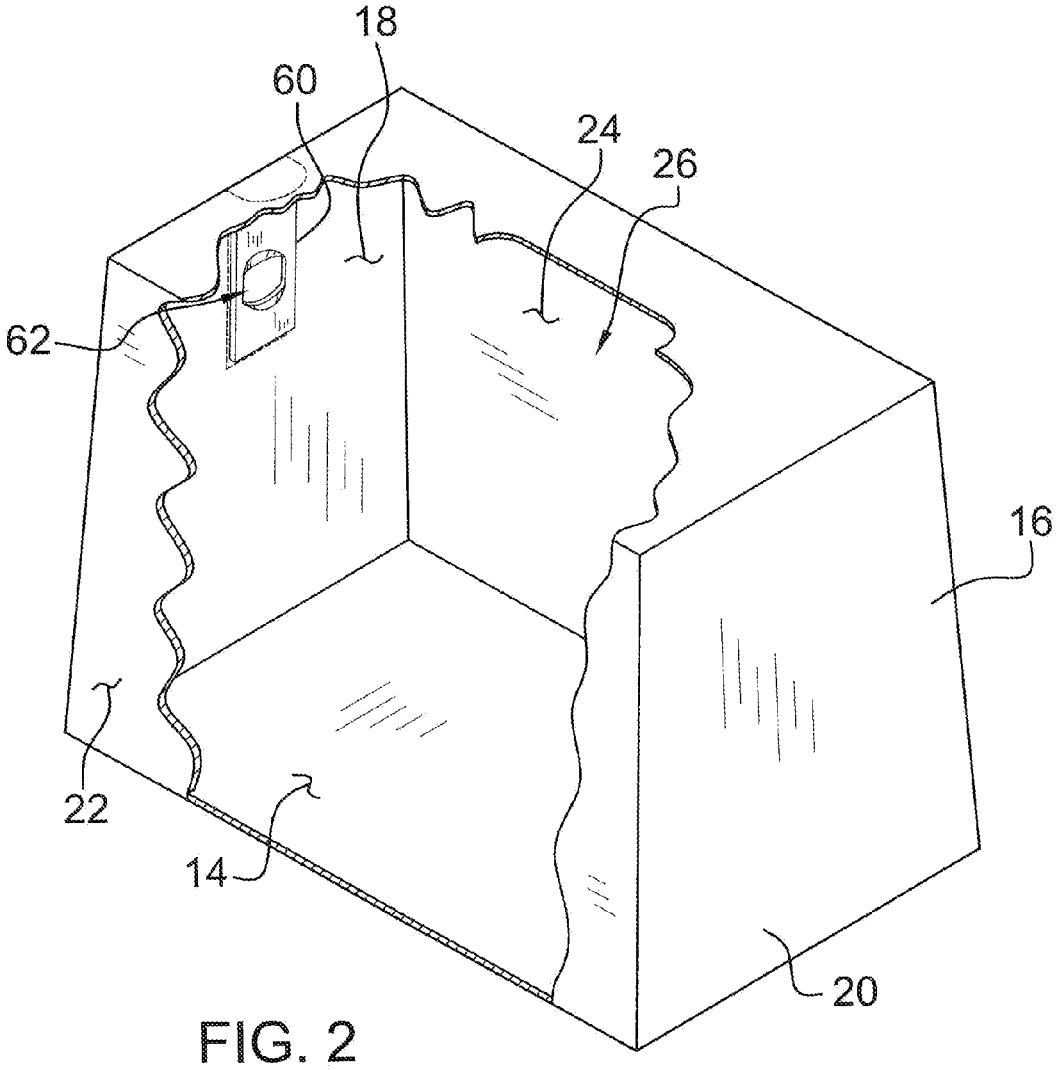
FIG. 2 is a partial-cutaway top back side perspective view of an embodiment of the disclosure.
Figure 3:
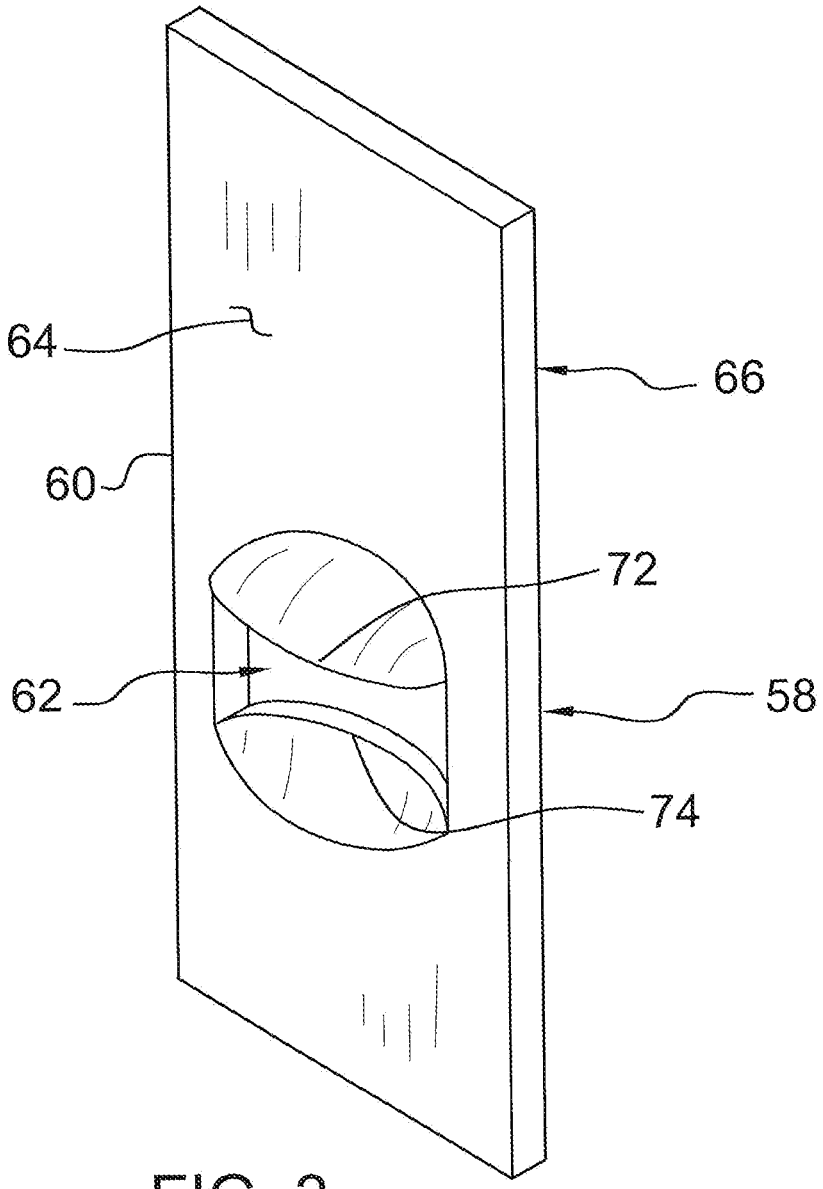
FIG. 3 is a top front side perspective view of a bottle opener of an embodiment of the disclosure.
Figure 4:
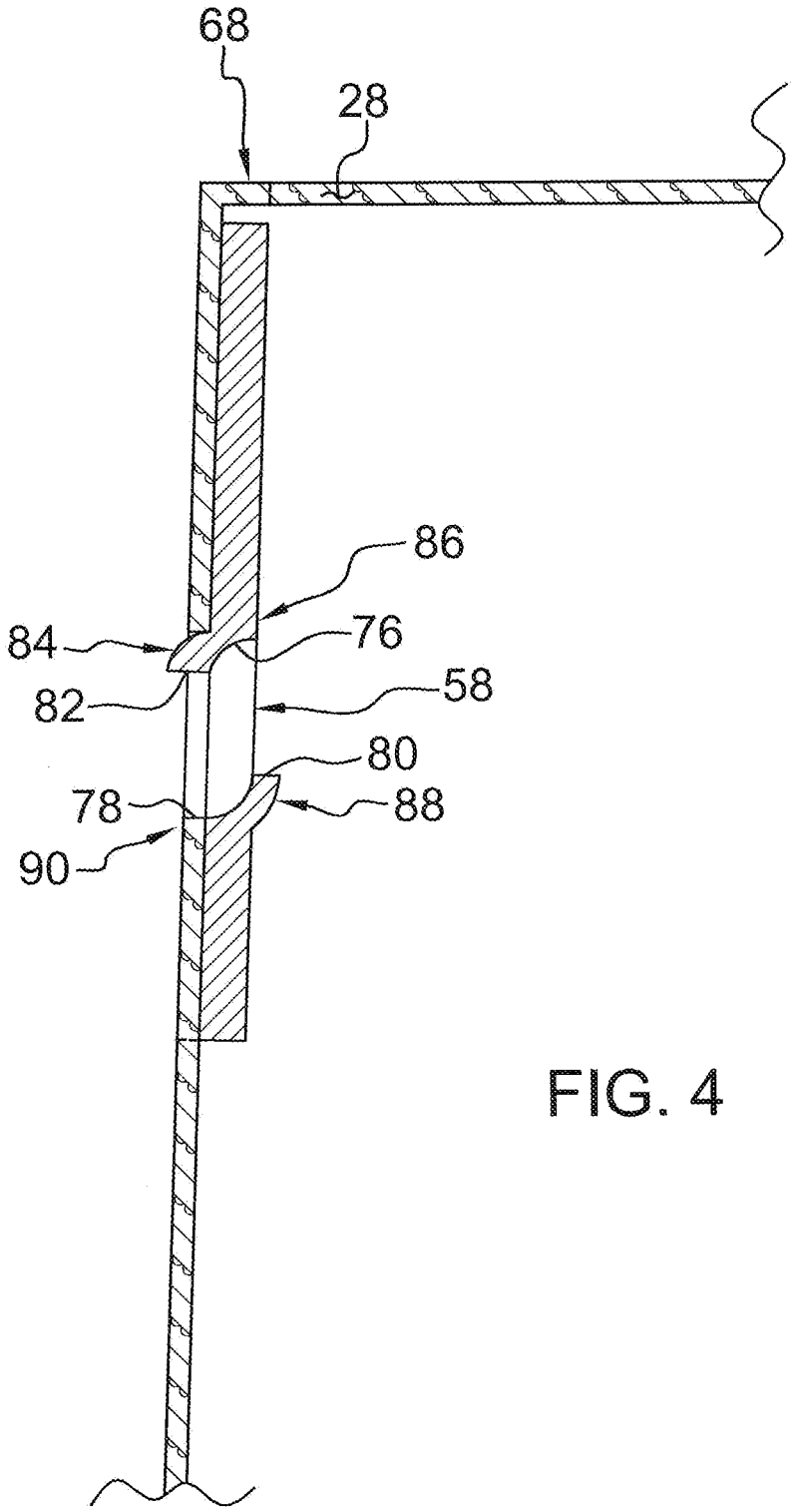
FIG. 4 is a cross-sectional view of an embodiment of the disclosure taken along line 4-4 of FIG. 1.
Figure 5:
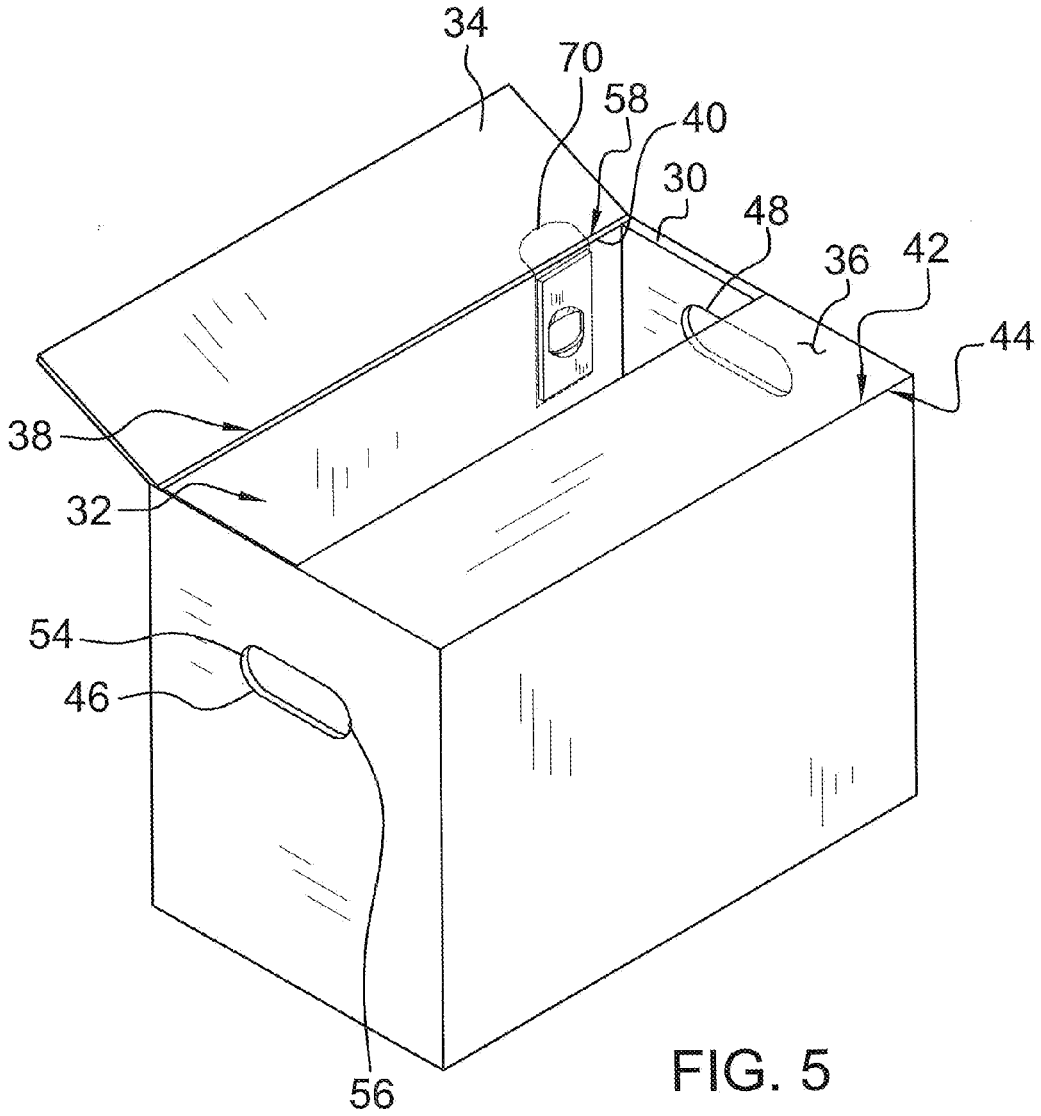
FIG. 5 is a top front side perspective view of an alternative embodiment of the disclosure.

With reference now to the drawings, and in particular to FIGS. 1 through 5 thereof, a new beverage carrying assembly embodying the principles and concepts of an embodiment of the disclosure and generally designated by the reference numeral 10 will be described.

As best illustrated in FIGS. 1 through 5, the beverage carrying assembly with bottle opener 10 generally comprises a container 12 having a bottom side 14 and a perimeter wall 16 extending upwardly from the bottom side 14. The perimeter wall 14 further comprises a front side 18 opposite a back side 20 and a pair of lateral sides 22, 24 extending between the front side 18 and the back side 20. The container 12 has an interior space 26 configured to hold a plurality of bottles therein. In the preferred embodiment, the container 12 is large enough to hold twelve bottles or more. Thus, the container 12 has a height between approximately 7.0 centimeters and 12.0 centimeters; a length between approximately 2.5 centimeters and 6.0 centimeters; and a length between approximately 0.05 centimeters and 2.5 centimeters. The container 12 is preferably comprised of a deformable material 28, such as cardboard or similar material.

In an alternative embodiment, a perimeter edge 30 of the container 12 defines an opening 32 into the container 12. A first panel 34 and a second panel 36 are coupled to the container 12. A first edge 38 of the first panel 34 is hingedly coupled to a first side 40 of the perimeter edge 30. A first edge 42 of the second panel 36 is hingedly coupled to a second side 44 of the perimeter edge 30. The first 34 and second 36 panels are selectively positionable to open and close the opening 32 into the container 12. Like the container 12, each of the first 34 and second 36 panels is preferably comprised of a deformable material 28, such as cardboard or similar material.

A pair of gaps 46, 48 extends through the container 12. The gaps 46, 48 may be positioned to extend longitudinally through a top side 50 of the container 12. The gaps 46, 48 have a size configured to receive fingers of a human hand wherein the gaps 46, 48 define a handle 52 configured for carrying the container 12. The gaps 46, 48 are preferably spaced and aligned. Each of the gaps 46, 48 may have an arcuate first end 54 and an arcuate second end 56. Alternatively, the gaps 46, 48 may be positioned in an associated one of the front side 18 and the back side 20 of the container 12. In this alternative embodiment, the gaps 46, 48 may also be horizontally aligned and centrally positioned between the lateral sides 22, 24 of the container 12.

A bottle opener 58 is removably coupled to the perimeter wall 14. The bottle opener 58 comprises a panel 60 and an opening 62 extending from a front side 64 to a back side 66 of the panel 60. The opening 62 of the bottle opener 58 may extend through the front side 18 of the perimeter wall 14. Alternatively, the opening 62 of the bottle opener 58 may extend through one of the lateral sides 22, 24 of the perimeter wall 14. The opening 62 of the bottle opener 58 has a size configured to receive a bottle cap therein. The panel 60 is preferably positioned within the interior space 26 of the container 12. The bottle opener 60 is preferably made from plastic, metal, or similar material.

A perforated section 68 of the container 12 extends around the bottle opener 58. A top portion 70 of the perforated section 68 may extend onto the top side 50 of the container 12. The top portion 70 of the perforated section 68 may be convexly arcuate. The perforated section 68 is removably positioned in the container 12 wherein tearing along perforations of the perforated section 68 removes the bottle opener 58 from the container 12. The bottle opener 58 may be adhesively coupled to the perforated section 68 through the use of hot glue or similar material.

An upper lip 72 and a lower lip 74 are provided. The upper lip 72 is preferably spaced from the lower lip 74. The upper lip 72 extends downwardly from a top edge 76 of the opening 62 of the bottle opener 58 and outwardly from the perimeter wall 14. The lower lip 74 extends upwardly from a bottom edge 78 of the opening 62 of the bottle opener 58. An upper edge 80 of the lower lip 74 and a lower edge 82 of the upper lip 72 are configured for receiving a lower edge of one of the bottle caps such that the bottle cap is removed when upward force is applied to the lower edge of the bottle cap. Each of the upper lip 72 and the lower lip 74 may be concavely arcuate wherein a front portion 84 of the upper lip 72 projects downwardly relative to a back portion 86 of the upper lip 72 and a back portion 88 of the lower lip 74 projects upwardly relative to a front portion 90 of the lower lip 74.

In use, as stated above and shown in the Figures, the bottle opener 58 is removed from the container 12 by tearing along perforations of the perforated section 68. Alternatively, the bottle opener 58 can remain positioned on the container 12 and used in the same manner. The lower edge of a bottle cap is inserted into the opening 62 of the bottle opener 58. Upward force is then exerted on the bottle cap in order to uncap the bottle. A user's fingers grasp the handle 52 to permit carrying of the container 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A beverage carrying assembly with bottle opener comprising:

a container having a bottom side and a perimeter wall extending upwardly from said bottom side, said container having an interior space configured to hold a plurality of bottles therein;

a bottle opener coupled to said perimeter wall, said bottle opener comprising a panel and an opening extending from a front side to a back side of said panel, said opening extending through said perimeter wall, said opening having a size configured to receive a bottle cap therein; and an upper lip and a lower lip, said upper lip extending downwardly from a top edge of said opening and extending outwardly of said perimeter wall, said lower lip extending upwardly from a bottom edge of said opening, an upper edge of said lower lip and a lower edge of said upper lip being configured for receiving the bottle cap such that an upper surface of the bottle cap is abutted by said lower edge of said upper lip and a lower edge of the bottle cap is contacted by said upper edge of said lower lip wherein the bottle cap is removed when upward force is applied to the lower edge of the bottle cap; and each of said upper lip and said lower lip being concavely arcuate wherein a front portion of said upper lip projects downwardly relative to a back portion of said upper lip and a back portion of said lower lip projects upwardly relative to a front portion of said lower lip.

2. The assembly of claim 1, further comprising said container being comprised of a deformable material.

3. The assembly of claim 1, further comprising a pair of gaps extending through said container, said gaps having a size configured to receive fingers of a human hand wherein said gaps define a handle configured for carrying said container, said gaps being spaced and aligned.

4. The assembly of claim 3, further comprising each of said gaps having an arcuate first end and an arcuate second end.

5. The assembly of claim 3, further comprising said gaps extending longitudinally through said container, said gaps being positioned in a top side of said container.

6. The assembly of claim 3, further comprising each of said gaps being positioned in an associated one of a front side and a back side of said container, each of said gaps being centrally positioned between a pair of lateral sides of said container, said gaps being horizontally aligned.

7. The assembly of claim 1, further comprising said bottle opener being removably coupled to said perimeter wall.

8. The assembly of claim 7, further comprising a perforated section of said container extending around said bottle opener, said perforated section being removably positioned in said container wherein tearing along perforations of said perforated section removes said bottle opener from said container.

9. The assembly of claim 8, further comprising a top portion of said perforated section extending onto a top side of said container, said top portion of said perforated section being convexly arcuate.

10. The assembly of claim 8, further comprising said bottle opener being adhesively coupled to said perforated section.

11. The assembly of claim 1, further comprising said panel being positioned within said interior space of said container.

12. The assembly of claim 1, further comprising said opening of said bottle opener extending through a front side of said perimeter wall.

13. The assembly of claim 1, further comprising said upper lip being spaced from said lower lip.

14. The assembly of claim 1, further comprising:

a perimeter edge of said container defining an opening into said container; and a first panel and a second panel coupled to said container, a first edge of said first panel being hingedly coupled to a first side of said perimeter edge, a first edge of said second panel being hingedly coupled to a second side of said perimeter edge, said first and second panels being selectively positionable to open and close said opening into said container.

15. The assembly of claim 14, further comprising each of said first panel and said second panel being comprised of a deformable material.

16. The assembly of claim 1, further comprising said opening of said bottle opener extending through one of a pair of lateral sides of said perimeter wall.

17. A beverage carrying assembly with bottle opener comprising:

a container having a top side opposite a bottom side and a perimeter wall extending between said top side and said bottom side, said perimeter wall further comprising a front side opposite a back side and a pair of lateral sides extending between said front side and said back side, said container having an interior space configured to hold a plurality of bottles therein, said container being comprised of a deformable material;

a pair of gaps extending longitudinally through said container, said gaps being positioned in said top side of said container, said gaps having a size configured to receive fingers of a human hand wherein said gaps define a handle configured for carrying said container, said gaps being spaced and aligned, each of said gaps having an arcuate first end and an arcuate second end;

a bottle opener removably coupled to said perimeter wall, said bottle opener comprising a panel and an opening extending from a front side to a back side of said panel, said opening extending through said front side of said perimeter wall, said opening having a size configured to receive a bottle cap therein, said panel being positioned within said interior space of said container;

a perforated section of said container extending around said bottle opener, a top portion of said perforated section extending onto said top side of said container, said top portion of said perforated section being convexly arcuate, said perforated section being removably positioned in said container wherein tearing along perforations of said perforated section removes said bottle opener from said container, said bottle opener being adhesively coupled to said perforated section; and an upper lip and a lower lip, said upper lip being spaced from said lower lip, said upper lip extending downwardly from a top edge of said opening and extending outwardly from said perimeter wall, said lower lip extending upwardly from a bottom edge of said opening, an upper edge of said lower lip and a lower edge of said upper lip being configured for receiving one of the bottle caps such that an upper surface of the bottle cap is abutted by said lower edge of said upper lip and a lower edge of the bottle cap is contacted by said upper edge of said lower lip wherein the bottle cap is removed when upward force is applied to the lower edge of the bottle cap, each of said upper lip and said lower lip being concavely arcuate wherein a front portion of said upper lip projects downwardly relative to a back portion of said upper lip and a back portion of said lower lip projects upwardly relative to a front portion of said lower lip.

18. A beverage carrying assembly with bottle opener comprising:

a container having a bottom side and a perimeter wall extending upwardly from said bottom side, said perimeter wall further comprising a front side opposite a back side and a pair of lateral sides extending between said front side and said back side, said container having an interior space configured to hold a plurality of bottles therein, said container being comprised of a deformable material;

a perimeter edge of said container defining an opening into said container;

a first panel and a second panel coupled to said container, a first edge of said first panel being hingedly coupled to a first side of said perimeter edge, a first edge of said second panel being hingedly coupled to a second side of said perimeter edge, said first and second panels being selectively positionable to open and close said opening into said container, each of said first panel, said second panel, and said container being comprised of a deformable material;

a pair of gaps extending through said container, each of said gaps being positioned in an associated one of said front side and said back side of said container, each of said gaps being centrally positioned between said lateral sides of said container, said gaps having a size configured to receive fingers of a human hand wherein said gaps define a handle configured for carrying said container, said gaps being horizontally aligned, each of said gaps having an arcuate first end and an arcuate second end;

a bottle opener removably coupled to said perimeter wall, said bottle opener comprising a panel and an opening extending from a front side to a back side of said panel, said opening of said bottle opener extending through one of said lateral sides of said perimeter wall, said opening of said bottle opener having a size configured to receive a bottle cap therein, said panel being positioned within said interior space of said container;

a perforated section of said container extending around said bottle opener, a top portion of said perforated section extending onto said top side of said container, said top portion of said perforated section being convexly arcuate, said perforated section being removably positioned in said container wherein tearing along perforations of said perforated section removes said bottle opener from said container, said bottle opener being adhesively coupled to said perforated section; and an upper lip and a lower lip, said upper lip being spaced from said lower lip, said upper lip extending downwardly from a top edge of said opening of said bottle opener and extending outwardly from said perimeter wall, said lower lip extending upwardly from a bottom edge of said opening of said bottle opener, an upper edge of said lower lip and a lower edge of said upper lip being configured for receiving one of the bottle caps such that an upper surface of the bottle cap is abutted by said lower edge of said upper lip and a lower edge of the bottle cap is contacted by said upper edge of said lower lip wherein the bottle cap is removed when upward force is applied to the lower edge of the bottle cap, each of said upper lip and said lower lip being concavely arcuate wherein a front portion of said upper lip projects downwardly relative to a back portion of said upper lip and a back portion of said lower lip projects upwardly relative to a front portion of said lower lip.

* * * * *